United States Patent [19]

Kardash

[11] 4,266,218

[45] May 5, 1981

[54] ALARM SYSTEM CONTROL CIRCUIT

[75] Inventor: John J. Kardash, Greenville, R.I.

[73] Assignee: Cherry Semiconductor Corporation, Cranston, R.I.

[21] Appl. No.: 950,867

[22] Filed: Oct. 12, 1978

[51] Int. Cl.[2] ..... G08B 17/10

[52] U.S. Cl. ..... 340/628; 250/381; 250/573; 340/629; 340/630; 356/438

[58] Field of Search ..... 340/628, 629, 630, 310 A; 250/574, 573, 381; 361/110, 111; 356/438

[56] References Cited

U.S. PATENT DOCUMENTS 4,106,007 8/1978 Johnston et al. ..... 340/310 A

*Primary Examiner*—John W. Caldwell, Sr.
*Assistant Examiner*—Daniel Myer
*Attorney, Agent, or Firm*—Charles E. Pfund

[57] ABSTRACT

A circuit for reducing or eliminating the sensitivity of alarm circuitry to false alarms caused by noise occurring synchronously with a 60 Hz line voltage. The 60 Hz line signal is applied to a variable-threshold circuit which produces a 60 Hz clock signal. The clock signal produced by the variable-threshold circuit may be selected to occur at different points during a cycle of the 60 Hz line signal. In response to successive alarm signals, the clock signal produced by the variable-threshold circuit occurs with different phasing relationships to the 60 Hz line signal. Before an alarm indication is made, an alarm signal must be provided by the smoke sensor in response to a plurality of successive samples. If, the alarm signal is a false alarm signal produced by the pickup of noise pulses which are synchronous with the 60 Hz line signal, subsequent samples taken at different points during a cycle of the line frequency sample the output from the smoke detection circuitry during periods when the alarm circuitry does not pick up such synchronous noise pulses; and the false signal is rejected.

24 Claims, 5 Drawing Figures

ALARM SYSTEM CONTROL CIRCUIT

FIELD OF THE INVENTION

This invention is related to smoke detectors and more particularly to circuits for preventing false alarms in smoke detectors.

BACKGROUND OF THE INVENTION

Recently there has been a much increased interest in smoke detectors. The devices are typically mounted on a ceiling and produce a warning tone in response to the detection of smoke or products of combustion in the air. Such smoke detectors are available using different techniques for performing the actual detection of the presence of smoke, including ionization chambers and photoelectric detection of the obscuration or scattering of light caused by the presence of smoke.

One of the important considerations in designing any type of smoke detector is reducing the occurrence of false alarms. In order to reduce false alarms, many smoke detection circuits periodically sample or strobe the particular smoke detection apparatus being used. These circuits require that the smoke detection circuitry produce an alarm signal indicating the presence of smoke at its output for a predetermined number of consecutive samples before an alarm indication is provided to minimize false alarms caused by noise transients.

In many smoke detectors the time base used for strobing the smoke detection circuitry is derived from the 60 Hz A.C. line voltage. Such a technique has been found to be susceptible to false alarms in response to noise occurring synchronously with the 60 Hz line voltage. Syncrhonous noise may be caused, for example, by electronic regulators found in light dimmers, fans, etc. Many other common electrical appliances also produce noise which is synchronous with the line voltage. The voltages produced by the smoke detection elements are generally very small; and electromagnetic radiation produced by such synchronous noise sources may be picked up by the smoke detector circuitry to cause a false alarm. Such interference may also be capacitively or inductively coupled into the smoke detector circuitry.

SUMMARY OF THE INVENTION

The present invention is concerned with reducing or eliminating the sensitivity of smoke detection circuitry to false alarms caused by noise occurring synchronously with the 60 Hz line voltage which is coupled into the smoke detector circuitry. Briefly, the present invention operates in the following manner. A signal derived from the 60 Hz line signal is applied to a variable-threshold circuit which produces a 60 Hz clock signal. In response to a second input signal to the variable-threshold circuit, the clock signal produced thereby may be selected to occur at different points during a cycle of the 60 Hz line signal. In other words, by varying the second input to the variable-threshold circuit, the phasing relationship may be changed between the 60 Hz line voltage and the 60 Hz clock signal. The present invention requires that an alarm signal be provided by the smoke sensor in response to a plurality of successive samples. In response to successive alarm signals produced during successive samples, the present invention varies the second input signal to the variable-threshold circuit so that the clock signal produced thereby occurs with a different phasing relationship to the 60 Hz line signal during each successive sample. Thus, if the alarm signal is a false alarm signal produced by the pickup of noise pulses which are synchronous with the 60 Hz line signal, subsequent samples which are taken at different points during a cycle of the line frequency will sample the output from the smoke detection circuitry during periods when the circuitry does not pick up such synchronous noise pulses; and the false alarm signal is rejected.

DESCRIPTION OF THE DRAWINGS

These and other advantages of the present invention will become more clear upon reading the following detailed description of the invention in conjunction with the drawings, of which.

DETAILED DESCRIPTION OF THE INVENTION

Figure 1:
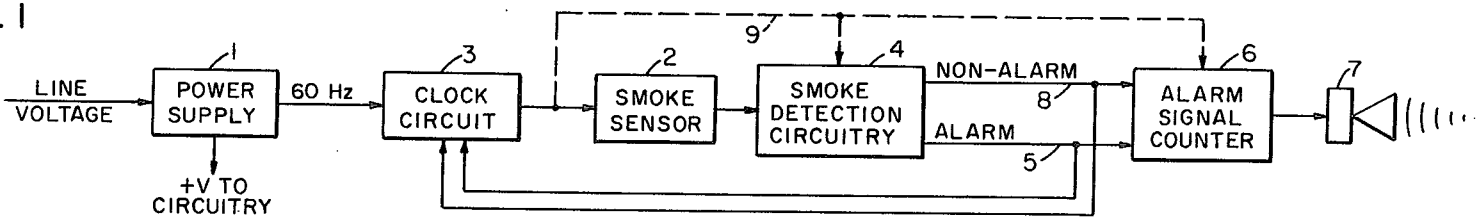
FIG. 1 is a block diagram showing a typical smoke detection system with which the present invention may be used.

Referring to FIG. 1, there is a block diagram which shows generally the different sections of a typical smoke detection alarm circuit. A smoke sensor 2 is located in the area which is being monitored for presence of smoke. Any of the several available type sensors may be used for smoke sensor 2, including photoelectric backscatter sensors, photoelectric obscuration sensors, and ionization chamber sensors. A 60 Hz signal derived from the A.C. line voltage signal is taken from a power supply 1 connected to the power line and applied to a clock circuit 3 which generates system clock pulses at its output. These clock pulses are used to strobe or sample the output from smoke sensor 2, and may also be applied to other parts of the smoke detector as a system clock signal, as shown by dotted lines in FIG. 1. In response to a sample pulse from clock circuit 3 applied to smoke sensor 2, the output signal therefrom is applied to smoke detection circuitry 4. The configuration of the smoke detection circuitry depends upon the type of smoke sensor used, and may be implemented in any of many ways known by those in the field. Smoke detection circuitry 4 produces an alarm signal on line 5 in response to an output from smoke sensor 2 indicating the presence of smoke.

The alarm signal on line 5 is applied to an alarm signal counter circuit 6 which counts the number of alarm signals and activates a horn 7 or other warning device in response to the occurrence of a predetermined number of consecutive alarm signals from smoke detection circuitry 4. Smoke detection circuitry 4 also provides a non-alarm signal on line 8 which resets alarm signal counter 6 if the required number of alarm signals has not been produced.

The alarm signal on line 5 may also be applied to clock circuit 3 to to cause the frequency of sampling pulses applied to smoke sensor 2 to increase upon the occurrence of an alarm signal. Smoke sensor 2 might typically be triggered by pulses from clock circuit 3 once every ten seconds. In response to an alarm signal applied to clock circuit 3, clock circuit 3 switches to a "fast mode" and produces sample pulses four times as fast or once every 2.5 seconds. The non-alarm signal may also be applied to clock circuit 3 to switch from fast mode to normal mode in response to the absence of an alarm signal.

Figure 2:
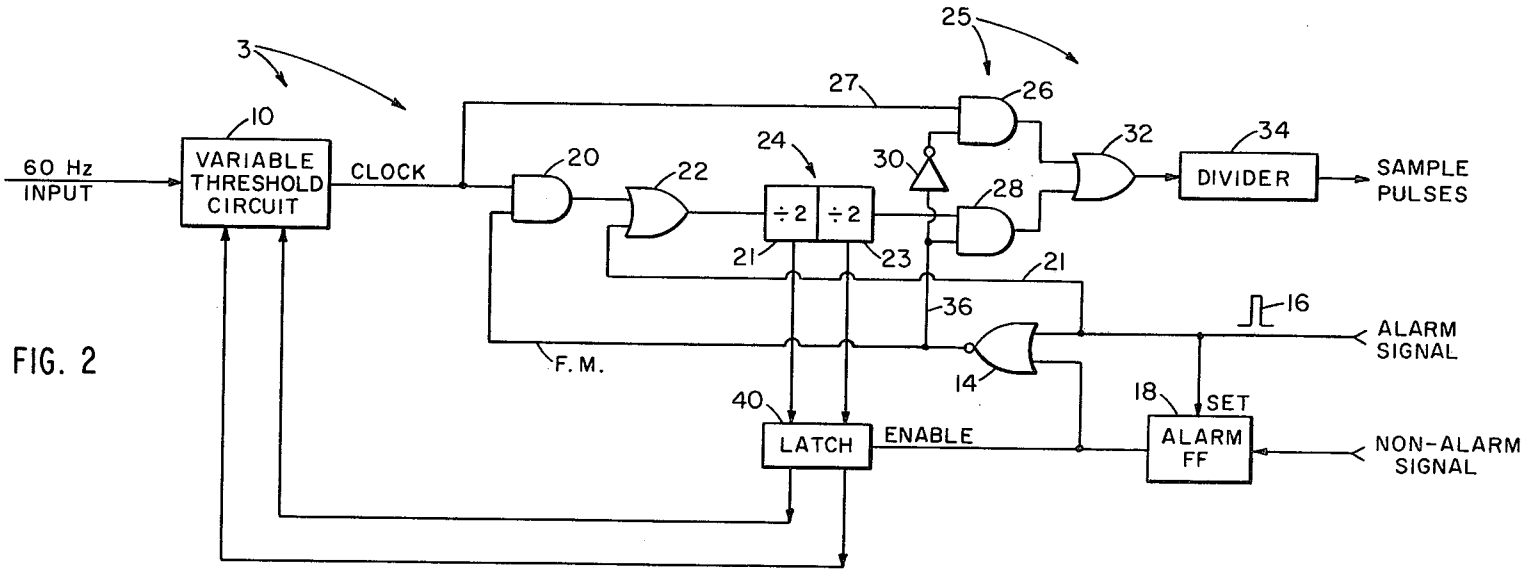
FIG. 2 shows in more detail a clock circuit in accordance with the present invention.

Referring to FIG. 2 there is shown a block diagram of circuitry for implementing the clock circuit 3 shown in FIG. 1. From the 60 Hz input signal, clock circuitry 3 produces sample pulses which are used to sample or strobe the smoke sensor 2. In the implementation of FIG. 2 the sampling pulses may have one of four possible phasing relationships to the 60 Hz input signal; and by properly selecting the phasing relationship between the sampling pulses and 60 Hz input, false alarms due to noise which is synchronous with the 60 Hz line signal are reduced or eliminated.

In FIG. 2, the 60 Hz line signal is applied to a variable-threshold circuit 10. Variable-threshold circuit 10 also receives inputs from a latch circuit 40 whose operation is described below. In response to signals from latch circuit 40, variable-threshold circuit 10 provides a 60 Hz clock signal at its outpt whose phasing with respect to the 60 Hz input signal is determined by the input signals from latch circuit 40. One method of implementing variable-threshold circuit 10 is with a Schmitt-trigger circuit whose threshold is varied in response to signals from latch 40.

The clock signal from variable-threshold circuit 10 is used to increment counters which control the timing sequences for the smoke detector. Two different timing sequences are used. If the smoke detector circuitry does not produce an alarm signal, the system is in "normal mode" and the smoke detection circuitry output is strobed or sampled once every ten seconds. In response to an alarm signal from the smoke detection circuitry, indicating the presence of smoke, a "fast mode" begins which typically increases the sampling rate by a factory of 4 so that the smoke detector output would be sampled every 2.5 seconds. Alarm-signal counter circuit 6 requires that a plurality of consecutive alarm signals be generated in response to consecutive sample pulses before an alarm is sounded. In the circuitry described herein, four consecutive alarm signals are required. If fewer than four alarm signals occur consecutively, the system is reset and a new cycle begins.

The alarm signal from the smoke detection circuitry is applied to one inut of NOR gate 14. The alarm signal is normally low in the non-alarm condition and goes high to signify the detection of smoke, as shown by waveform 16. A second input to NOR gate 14 comes from alarm flip flop 18. When no smoke is present, the non-alarm signal applied to the reset input of alarm flip-flop 18 causes the output of alarm flip flop to remain in the low state. Thus, in the absence of an alarm signal, both inputs to NOR gate 14 are low and the output from NOR gate 14 is high. When the alarm signal goes high, the output of NOR gate 14 goes low and is held low by the high output from alarm flip flop 18 until a non-alarm signal occurs. The output of NOR gate is designated as the fast mode or "FM" signal.

The clock signal from variable-threshold circuit 10 is applied to one input of an AND gate 20. The output from gate 14 is applied as a second input to AND gate 20 and serves to gate the clock signal from variable-threshold circuit 10. The output from AND gate 20 is applied to an OR gate 22; and the output from OR gate 22 is applied to a divide-by-four counter 24 composed of two flip flops 21 and 23. The alarm signal is applied to a second input of OR gate 22. In the absence of an alarm signal, the clock signal from variable-threshold 10 is applied by gates 20 and 22 to counter 24.

A selection circuit 25, composed of two AND gates 26 and 28, inverter 30, and OR gate 32, selects one of two signals in response to a selection signal provided thereto on line 36. The selected signal is applied to the clock input to a divider chain 34. The output from NOR gate 14 is applied to AND gate 28 and is inverted by inverter 30 and applied to AND gate 26. The outputs from AND gate 26 and 28 are combined by OR gate 32 and the output from OR gate 32 clocks divider chain 34. In the absence of an alarm signal, the output from NOR gate 14 is high, enabling AND gate 28 and disabling AND gate 26. This causes selection circuit 25 to select the output from counter 24 for application to divider chain 34. The divider chain 34 is chosen so that in combination with divide-by-four counter 24, the clock signal from variable-threshold circuit 10 is counted down to provide a sampling signal 38 at the output of the divider chain 34 which is composed of one pulse every ten seconds. This is the signal used to sample or strobe the smoke sensor 2.

The output from alarm flip flop 18 is applied to the enable input of latch 40. The outputs from flip flops 21 and 23 of counter 24 are applied to the inputs to latch 40 which in response provides the above-described inputs to variable-threshold circuit 10. During non-alarm conditions the enable input to latch 40 is low and the value stored by latch 40 remains unchanged.

In response to an alarm signal, the circuitry shown in FIG. 2 operates as follows. When the alarm signal goes high, it causes the output from NOR gate 14 to go low, disabling AND gate 20 to disconnect counter 24 from the clock signal from variable-threshold circuit 10. The low output from NOR gate 14 is also applied on line 36 to selection circuit 25 disabling AND gate 28 and enabling AND gate 26. This effectively disconnects counter 24 from divider chain 34 an applies the clock signal from variable-threshold circuit 10 directly to the clock input of divider 34. Since the division by 4 previously performed by counter 24 is now bypassed, the system clock 38 from divider chain 34 is now increased in frequency by a factor of 4 so that one clock pulse occurs by 2.5 seconds. Thus, the circuitry shown in FIG. 2 automatically switches from normal mode to fast mode in response to the occurrence of an alarm signal.

The low output signal from NOR gate 14 also disables AND gate 20 disconnecting counter 24 from the clock signal from variable-threshold circuit 10. Instead, counter 24 now counts alarm signal pulses which are applied to the clock input of flip flops 24 via OR gate 22. Thus, in response to successive alarm pulses, flip flops 21 and 23 count through their four different states. When alarm flip flop 18 is set by an alarm signal, the enable input to latch 40 goes high allowing the latch outputs to change state in response to the outputs from flip flops 21 and 23. As flip flos 21 and 23 cycle through their four states, these oututs are applied to latch 40. As flip flops 21 and 23 are clocked from state to state, variable-threshold circuit 10 provides a clock signal at different portions of the 60 Hz input signal.

Figure 3A:
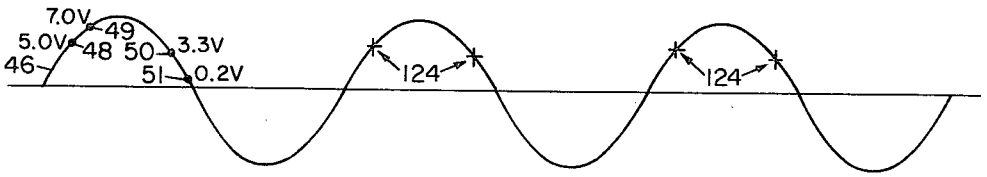
FIGS. 3*a* and 3*b* show waveforms useful in explaining the clock circuit of the present invention.

This is more clearly shown by referring to FIG. 3*a* where the 60 Hz input signal 46 is shown. The different possible threshold values of variable-threshold circuit 10 are shown on waveform 46 denoted as 48 through 51, respectively corresponding to thresholds of 0.5, 7.0, 3.3, and 0.2 volts. While these threshold values are not critical and other values may be used, it has been found to be advantageous in rejecting noise to have one value be zero volts or as close thereto as practical so that one of the phasing relationships is when sample pulses are produced at the time the line voltage goes through zero. This corresponds to 0.2 volt threshold point 51. In response to sequential alarm signals, the clock signals from variable-threshold circuit 10 occur at successive threshold values. Thus, if the alarm signal is caused by noise occurring sequentially with the 60 Hz line voltage, the clock signal used to trigger the smoke alarm circuitry will be produced at different phasing relationships with respect to the 60 Hz line voltage in an attempt to avoid false alarms caused by this noise. If the alarm signal is, in fact, caused by pickup of noise occurring synchronously with the line voltage, the above-described variation of phasing between the line voltage and the sample pulses 38 will generally eliminate the false alarms. If such is the case, in response to the next sample pulse 38, the alarm signal from the smoke detection circuitry remains low and the non-alarm signal goes high resetting alarm flip flop 18. The outut from alarm flip flop 18 goes low clocking the present state of counter 24 into latch 40. Thus, latch 40 stores the digital value which corresponds with a phasing relationship between the line signal input and system clock 38 which avoids false alarms. The low output from alarm flip flop 18 also reinserts divide-by-four counter 24 between variable-threshold circuit 10 and divider chain 34 so that the system returns to normal mode, strobing the smoke detection circuitry once every ten seconds.

It should be appreciated that the clock circuit shown in FIG. 2 may be used advantageously with alarm systems other than smoke detection alarms to provide increased discrimination against false alarms caused by pickup of noise which is synchronous with the power line frequency. It should also be clear that the invention may equally well be used with power line frequencies other than the 60 Hz frequency used as an example herein.

Figure 4:
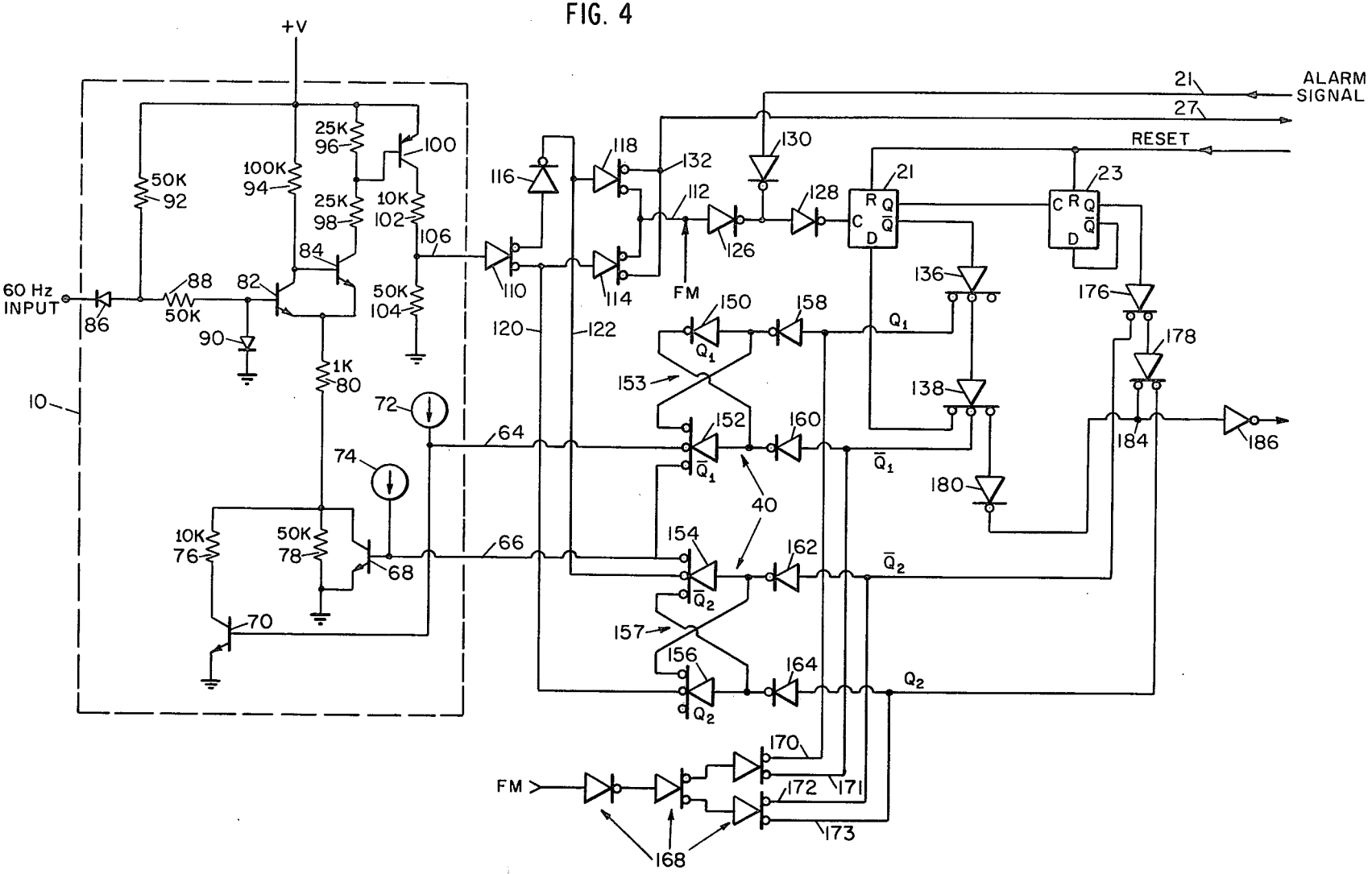
FIG. 4 shows circuitry of one preferred embodiment of the present invention.

Referring to FIG. 4, there is shown a current injection logic circuit for implementing clock circuit 3. Variable-threshold circuit 10 receives a 60 Hz input signal derived from the line voltage. The outputs from latch 40 of FIG. 2 are applied to lines 64 and 66 to the variable-threshold circuit 10, and in response to the different digital values present on these lines, the variable-threshold circuit produces clock pulses having different phasing relationships to the 60 Hz input signals.

The signals on lines 64 and 66 are applied to the base terminals of two transistors 68 and 70. The bases of transistors 64 and 66 are connected to respective current sources 72 and 74. The outputs of current injection logic are current sinking outputs, and current sources 72 and 74 hold transistors 68 and 70 in the "on" state unless the outputs on lines 64 and 66 are low. A 10K resistor 76 is in series with transistor 70 and a 50K resistor 78 is shunted by transistor 68. Resistors 76 and 78 are connected in parallel with each other and in series with a 1K resistor 80, the other end of which is connected to the emitter terminals of two transistors 82 and 84. By changing the digitial value on lines 64 and 66, the emitter resistance seen by transistors 82 and 84 is varied.

The 60 Hz input signal from input terminal 62 is applied by a diode 86 and a 50K resistor 88 to the base terminal of transistor 82. A second diode 90 is connected between the base terminal of transistor 82 and ground. Diodes 86 and 90 provide protection from high voltage transients. A 50K resistor 92 is connected between the positive voltage supply and the junction of diode 86 and resistor 88. When the 60 Hz input signal is higher than the voltage present at the junction of resistor 88 and 92, diode 86 is reverse-biased and a base current is supplied via these resistors to transistor 82 causing it to conduct. The value of collector current through transistor 82 is determined by the resistance in the emitter circuit, controlled as described above.

As the 60 Hz input signal decreases below the quiescent voltage at the junction of resistors 88 and 92, diode 86 begins to conduct and the base current to transistor 82 is reduced eventually turning transistor 82 off. The collector of transistor 82 is connected via a load resistor 94 to the positive voltage supply, and the voltage at the collector of transistor 82 is applied to the base terminal of transistor 84. Due to the common emitter resistance of transistors 82 and 84, the circuit exhibits hysteresis, and the switching points are different for positive and negative slopes of the 60 Hz input signal. The load resistance in the collector of transistor 84 is composed of two equal valued transistors 96 and 98, and the voltage at the junction of resistors 96 and 98 is applied to the base terminal of a third transistor 100. The emitter of transistor 100 is connected to the positive voltage supply, and transistor 100 turns rapidly on and off as the voltage applied its base terminal exceeds the base-to-emitter voltage of the transistor. Two resistors 102 and 104 are in series between the collector terminal of transistor 100 and ground. The value of these resistors is not critical, and the voltage at the junction of these resistors provides the output from circuit 60.

In response to the 60 Hz input signal, the variable-threshold circuit 10 provides a digital output signal at terminal 106. The switching point of circuit 10 depends on the current through transistors 82 and 84, which is in turn controlled by switching resistors 76 and 78 in and out of the emitter circuits of these transistors as described above. In this manner, a digital output signal is provided which has one of four possible phasing relationships to the input signal.

The output from circuit 10 is applied to the input of current injection logic gate 110. The clock signal at the input to gate 110 is eventually applied to node 112 via one of two alternate paths and the signal at node 112 clocks flip flop 23. One output from gate 110 is applied to the input of a second gate 114 whose output is directly connected to node 112. A second output from gate 110 is applied via two gates 116 and 118 to node 112. Each of the gates 114 through 118 inverts the signal applied thereto, and the signals applied to the inputs of gates 114 and 118 are identical but of opposite polarity. Two lines 120 and 122 are respectively connected to the output of gates 110. By holding one of lines 120 or 122 low, one of gates 114 and 118 is disabled; and the clock signal from the other of these gates is applied to node 112, allowing the polarity of the clock signal from circuit 10 to be selected.

Figure 3B:
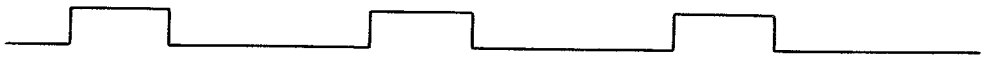

Referring to FIGS 3*a* and 3*b*, it can be seen that the threshold points 48–51 occur for both positive and negative slopes of the 60 Hz waveform. This is done to spread the possible clock phases out over a larger time to increase noise rejection. Since the output at terminal 106 from circuit 10 changes state each time the 60 Hz waveform 46 goes through the selected threshold point, the polarity of the signal must be properly chosen to position the sampling point as shown in FIG. 3*a*. For example, if the digital signals apply to circuit 60 indicate that the 3.3 volt threshold point 56 is to be chosen, the output from output from circuit 10 changes state each time waveform 46 passes through 3.3 volt. These points are designated by the "X's" marked 124 in FIG. 3*a*. The output waveform which results is then as shown in FIG. 3*b*. Selecting other threshold points will produce similar waveforms. For the 5-volt and 7-volt thresholds, the clock pulse must occur during the positive-slope portions of the 60 Hz waveform; and thus the positive edge of the digital waveform from circuit 60, shown in FIG. 3*b* is used to increment the following counters. For the 3.3 volt and 0.2 volt thresholds, the falling edge of the waveform in FIG. 3*b* must be used to clock the following counters. Counters 24 and 34 are clocked by a falling edge, and by selectively inverting the waveform shown in FIG. 3*b* either the rising or falling edge of this waveform may be used to clock the counters.

During normal mode operation the signal present at node 112 applied via gates 126 and 128 to flip flop 24. The fast mode FM signal from NOR gate 14 is connected to the input of gate 126. During fast mode, the FM signal goes low disabling gate 126 and disconnecting counters 24 and 25 from the clock signal from circuit 10. In place of the clock signal, the alarm signals are applied via a gate 130 to the input of gate 128, and flip flops 21 and 23 are incremented by the alarm signal pulses during fast mode. Gates 114 and 118 have second outputs which are connected at node 132, and this signal is applied via line 27 to AND gate 26 to provide the faster clock signal for divider 34 during the fast mode.

Flip flop 21 is a D-type flip flop which has its $\overline{Q}$ output fedback to the D input via gates 136 and 138 so that it toggles in response to pulses applied to its clock input. Similarly flip flop 23 is a D flip flop whose $\overline{Q}$ input is directly connected to its D input. The $\overline{Q}$ output from flip flop 21 is applied to the clock input of flip flop 23, and flip flops 21 and 23 form divide-by-four counter 24.

As shown in FIG. 2 the outputs from flip flops 23 and 24 are applied to latch circuit 40. Latch circuit 40 is made up of two pairs of cross-connected gates forming set-reset flip flops. In FIG. 4 gates 150 and 152 each have their outputs connected to the input of the other gate to form a set-reset flip flop or latch 153 which is used to store the output from flip flop 23. Similarly gates 154 and 156 connected to form a second latch 157 and store the output of flip flop 24. The inputs to latches 153 and 157 are provided by four buffer inverters 158–164 whose outputs are respectively connected to the inputs of gates 150–156. The input to buffer inverters 158–164 are each connected to an output from gate 168. The input to gate 168 is the FM signal. In response to a high FM signal designating the normal mode of operation, the four outputs from gate 168 on lines 170–173 go low clamping the inputs of buffer inverters 158–166 and preventing latches 40 from changing state. During fast mode the FM signal goes low and the outputs from gate 168 no longer hold the inputs to buffers 158–166 low, allowing latches 153 and 157 to change state in response to the digital values stored in flip flops 21 and 23.

The $\overline{Q}$ output of flip flop 21 is applied to a gate 136. One output from gate 136 is applied to the input of buffer gate 158. A second output from gate 136 is inverted by gate 138 and applied to the input of buffer 160, so that the inputs to buffer 158 and 160 will be of opposite polarity. During fast mode when the inputs to buffers 158–166 are not held low, latch 153 changes state as flip flop 21 toggles. Similarly the $\overline{Q}$ output of flip flop 23 is applied via a gate 176 to the input of buffer 162; and another output from gate 176 is inverted by gate 178 and applied to the input of buffer 166. Latch 157 changes state in response to the toggling of flip flop 23.

A third output from gate 138 is combined via an inverter 180 with a second output from gate 178. The node 184 at the connection of the outputs of gates 178 and 180 is high only when flip flops 21 and 23 are both in the high state; otherwise, node 184 is low. This signal is applied to the input of a buffer inverter 186, and the output of buffer 186 provides the output from flip-flops 23–24 which is applied to AND gate 28 in FIG. 2.

The outputs from gate 152 is connected to line 64. Gates 154 and 156, which store the output from flip flop 23, each have an output therefrom which is connected to lines 120 and 122 described above. The signals on these lines which are always complimentary select either the positive or negative edge of the clock signal from circuit 60 for triggering flip flop 21, as discussed above in connection with FIG. 3*b*. Line 66 is connected to outputs from both gates 152 and 154 and is high only when both outputs are high. Thus, only three different digital values are possible on lines 64 and 66. However, due to the aforementioned hysteresis in the switching of transistors 82 and 84, the different edges selected by lines 120 and 124 result in four different threshold values.

The non-alarm signal which is used to reset alarm flip flop 18 may also be applied to reset inputs of flip flops 23 and 24 via a line 179 so that these flip flops will always start from the same initial state following the occurrence of a non-alarm signal. This ensures that the time between normal mode samples is always exactly 10 seconds.

There has been described a new and novel circuit for adjusting the phasing relationship of a clock signal with respect to a line voltage signal so as to avoid interference problems resulting from noise which is synchronous with the line voltage. Modifications and additions to the preferred embodiment will occur to those of ordinary skill in applying the teachings of the present invention. Therefore, the present invention is not to be limited by the above discussion of a preferred embodiment but rather is to be interpreted only in accordance with the appended claims.

What is claimed is:

1. A smoke detection alarm system comprising:

smoke detection means responsive to a clock signal applied thereto for producing an alarm signal representative of the presence of smoke;

means for providing an output indication of the presence of smoke upon the production of a predetermined number of consecutive alarm signals by the smoke detection means;

phase selection means for producing a phase selection signal and for changing the phase selection signal in response to the production of an alarm signal by the smoke detection means;

clock means responsive to the phase selection signal and to an A.C. line signal for producing a variable phase clock signal having a phase relationship with respect to the A.C. line signal which is determined by the phase selection signal; and means for applying the variable phase clock signal to the smoke detection means.

2. The system of claim 1 wherein the clock means includes:

means responsive to the phase selection signal for selecting one from a plurality of threshold signals, each of the plurality of threshold signals corresponding with different one of the polarity of phase relationships;

means for comparing the A.C. line signal with the selected threshold signal and for producing an output signal representative of equality therebetween; and means for producing the variable phase clock signal in response to the comparing means output signal.

3. The system of claim 2 wherein the comparing means includes a Schmitt-trigger circuit.

4. The circuit of claim 2 wherein one of the threshold signals is substantially zero.

5. The systems of claim 2 wherein one of the threshold signals correspond with a phase relationship such that the variable phase clock signal occurs at substantially the time when the A.C. line voltage passes through zero.

6. The system of claim 2 wherein the phase selection means includes a counter for counting the alarm signals, the counter outputs providing the phase selection signal.

7. The system of claim 6 further including:

register means for storing the phase selection signals produced in response to the last occurring alarm signal.

8. The system of claim 7 wherein the alarm system is operative to produce a non-alarm signal representative of the absence of an alarm condition;

the system further including means for applying the non-alarm signal to the register means to store the present phase selection signal therein.

9. The system of claim 2 wherein the predetermined number of consecutive alarm signals is equal in number to the plurality of phasing relationships so that an alarm signal must be produced by the smoke detection means for each of the plurality of phase relationships before an output signal is produced by the alarm system.

10. The system of claim 9 wherein the predetermined number and the plurality of phasing relationships are each four.

11. In an alarm system of the type having: means for producing a periodically-occurring sampling signal in response to an A.C. line signal; means for testing for the presence of an alarm condition in response to the sampling signal and for producing an alarm signal upon the detection of the presence of an alarm condition; and means for producing an output signal in response to a predetermined number of consecutive alarm signals produced by the testing means in response to consecutive sampling signals; the improvement comprising:

means for changing the phase relationship between the A.C. line signal and the sampling signal in response to an alarm signal.

12. In an alarm system for the type having: means for producing a periodically-occurring sampling signal in response to an A.C. line signal; means for testing for the presence of an alarm condition in response to the sampling signal and for producing an alarm signal upon the detection of the presence of an alarm condition; and means for producing an output signal in response to a predetermined number of consecutive alarm signals produced by the testing means in response to consecutive sampling signals; the improvement comprising:

means for changing the phase relationship between the A.C. line signal and the sampling signal in response to an alarm signal, including:

means for producing a clock signal having one of a plurality of phasing relationships with respect to the A.C. line signal; and means for selecting one of the plurality of phasing relationships and for changing the selected phasing relationship in response to an alarm signal produced by the testing means.

13. The system of claim 12 wherein the predetermined number of consecutive alarm signals is equal in number to the plurality of phasing relationships so that an alarm signal must be produced by the testing means for each of the plurality of phase relationships before an output signal is produced by the alarm system.

14. The system of claim 13 wherein the predetermined number and plurality of phasing relationships is four.

15. The system of claims 12, 13, or 14 wherein one of the phasing relationships is such that the sampling pulses occur substantially at the time when the line voltage passes through zero.

16. The system of claims 12, 13, or 14 wherein the means for producing a clock signal includes a Schmitt-Trigger circuit having a variable-threshold.

17. For use in an alarm system, a circuit for producing a clock signal derived from an A.C. line signal, comprising:

means for producing a variable-phase clock signal in response to the A.C. line signal, the variable-phase clock signal having a selected one of a plurality of possible phase relationships to the A.C. line signal, the selected one being determined in response to a phase selection signal;

means for producing the phase selection signal and for changing the phase selection signal in response to an alarm signal from the alarm system, including:

phase-selection means for producing phase selection signals to sequentially cycle through each of the plurality of phase relationships in response to the occurrence of successive alarm signals; and means for maintaining the presently selected phase relationship in the absence of an alarm signal.

18. The circuit claim 17 wherein the variable-phase clock producing means includes:

means responsive to the phase selection signal for selecting one from a plurality of threshold signals, each of the plurality of threshold signal corresponding with a different one of the phase relationships;

means for comparing the A.C. line signal with the selected threshold signal and for producing an output signal representative of equality therebetween; and means for producing the variable-phase clock signals in response to the comparing means output signal.

19. The circuit of claim 18 wherein the comparing means includes a Schmitt-trigger circuit.

20. The circuit of claim 18 wherein one of the threshold signals is substantially zero.

21. The circuit of claim 18 wherein one of the threshold signals corresponds with a phase relationship such that the variable-phase clock signal occurs at substantially the time when the A.C. line voltage passes through zero.

22. The circuit of claim 18 wherein the phase-selection means includes a counter for counting the alarm signals, the counter outputs providing the phase selection signal.

23. The circuit of claims 17, 18, or 22 wherein the means for maintaining includes register means for storing the phase selection signals produced in response to the last occurring alarm signal.

24. The circuit of claim 23 wherein the alarm system is operative to produce a non-alarm signal representative of the absence of an alarm condition;

the circuit further including means for applying the non-alarm signal to the register means to store the present phase selection signal therein.

* * * * *

UNITED STATES PATENT AND TRADEMARK OFFICE

CERTIFICATE OF CORRECTION

PATENT NO. : 4,266,218
DATED : May 5, 1981
INVENTOR(S) : John J. Kardash

It is certified that error appears in the above—identified patent and that said Letters Patent is hereby corrected as shown below:

col.3, line 38: change "factory" to--factor-- col.4, line 60: change "flos" to--flops-- col. 5, linel: change "0.5" to--5.0-- col. 5, line 24: change "outut" to--output--

Signed and Sealed this

*Twenty-ninth* Day of *December 1981*

[SEAL]

*Attest:*

GERALD J. MOSSINGHOFF

*Attesting Officer*

*Commissioner of Patents and Trademarks*